US010254047B2

(12) United States Patent
Frobose

(10) Patent No.: US 10,254,047 B2
(45) Date of Patent: Apr. 9, 2019

(54) FURNACE MUFFLE FOR AN ANNEALING FURNACE

(71) Applicant: SANDVIK MATERIALS TECHNOLOGY DEUTSCHLAND GMBH, Düsseldorf (DE)

(72) Inventor: Thomas Frobose, Versmold (DE)

(73) Assignee: SANDVIK MATERIALS TECHNOLOGY DEUTSCHLAND GMBH, Dusseldorf (DE)

( * ) Notice: Subject to any disclaimer, the term of this patent is extended or adjusted under 35 U.S.C. 154(b) by 663 days.

(21) Appl. No.: 14/893,914

(22) PCT Filed: May 15, 2014

(86) PCT No.: PCT/EP2014/059989
§ 371 (c)(1),
(2) Date: Nov. 24, 2015

(87) PCT Pub. No.: WO2014/191221
PCT Pub. Date: Dec. 4, 2014

(65) Prior Publication Data

US 2016/0123671 A1 May 5, 2016

(30) Foreign Application Priority Data

May 31, 2013 (DE) ..... 10 2013 105 628

(51) Int. Cl.
*F27D 19/00* (2006.01)
*F27B 5/10* (2006.01)
(Continued)

(52) U.S. Cl.
CPC ..... *F27D 19/00* (2013.01); *F27B 5/10* (2013.01); *F27B 5/18* (2013.01); *F27B 9/082* (2013.01);
(Continued)

(58) Field of Classification Search
CPC ..... F27D 19/00; F27B 5/10; F27B 5/18
See application file for complete search history.

(56) References Cited

U.S. PATENT DOCUMENTS 2,994,288 A 8/1961 Keller
6,027,544 A 2/2000 Arvidsson
(Continued)

FOREIGN PATENT DOCUMENTS

DE L15121 4/1953
JP H04151491 A 5/1992
(Continued)

*Primary Examiner* — Scott R Kastler
(74) *Attorney, Agent, or Firm* — Corinne R. Gorski

(57) ABSTRACT

A furnace muffle for an annealing furnace, the furnace muffle including a base body arranged to delimit a volume to be heated, at least one actuator connected to the base body in such a manner that the actuator, during the operation of the furnace muffle, can exert a force on the base body, at least one sensor arranged to detect a force exerted by the base body during the heating or cooling and/or a change in a length of the base body during the heating or cooling, and a control device connected to the actuator and the sensor, which is arranged so that during the operation of the furnace muffle, it controls the force exerted on the base body as a function of the force or change in length detected by the sensor.

14 Claims, 3 Drawing Sheets

(51) Int. Cl.

| | |
|---|---|
| ***F27B 5/18*** | (2006.01) |
| ***F27B 9/08*** | (2006.01) |
| ***F27D 21/04*** | (2006.01) |
| ***F27D 21/00*** | (2006.01) |

(52) U.S. Cl.
CPC ..... *F27D 21/00* (2013.01); *F27D 21/04* (2013.01); *F27D 2021/005* (2013.01)

(56) References Cited

U.S. PATENT DOCUMENTS

| | | | | |
|---|---|---|---|---|
| 2013/0029281 | A1 | 1/2013 | Jussel et al. | |
| 2016/0123671 | A1* | 5/2016 | Frobose ..... | F27B 5/10 148/508 |

FOREIGN PATENT DOCUMENTS

| | | | |
|---|---|---|---|
| JP | 2000028269 | A | 1/2000 |
| KR | 20040110327 | A | 12/2004 |
| KR | 10-0879842 | B1 | 1/2009 |

* cited by examiner

FURNACE MUFFLE FOR AN ANNEALING FURNACE

RELATED APPLICATION DATA

This application is a § 371 National Stage Application of PCT International Application No. PCT/EP2014/059989 filed May 15, 2014 claiming priority of DE Application No. 102013105628.8, filed May 31, 2013.

TECHNICAL FIELD

The present invention relates to a furnace muffle for an annealing furnace with a base body which is arranged so that it delimits a volume to be heated. The present invention further relates to an annealing furnace having such a furnace muffle.

BACKGROUND

Annealing furnaces are used in order to expose workpieces after the actual production or manufacturing in a controlled manner to a heating that improves the material properties.

In particular, stainless steel tubes manufactured by cold forming, i.e., for example, by cold pilgering or cold drawing, are annealed after the forming in an annealing furnace in order to increase the ductility of the material. To generate the temperatures needed for annealing steel tubes, it is sufficient for the annealing furnace to comprise a furnace muffle base body that is manufactured from metal or from another inexpensive available material that can be brought into nearly any shape.

However, it has been found that the base bodies of furnace muffles themselves undergo a considerable deformation, due to the heating of the volume delimited by them. This deformation is further increased since the furnaces are not operated continuously but are switched off temporarily to save energy and since they cool off during that period. Owing to these cooling and heating cycles, clear deformations of the furnace muffle occur.

The consequence of such a deformation of the furnace muffle or of their base bodies is that the muffle is subjected to increased wear and has to be replaced soon by a new muffle. In addition, in furnaces where the muffle itself is heated from the outside, i.e., the base body of the muffle is used as a radiation source for heating the volume enclosed by it, a deformation of the furnace muffle leads to the heating of the volume of the furnace becoming inhomogeneous, and the tempering or the annealing of the material becoming inefficient.

SUMMARY

Therefore, one problem of the present invention is to provide a furnace muffle whose base body does not undergo excessive deformation even during heating and/or pronounced temperature differences, as generated during the heating and cooling of an annealing furnace.

This problem is solved by a furnace muffle for an annealing furnace, with a base body which is set up so that the base body delimits a volume to be heated, wherein the furnace muffle further comprises: at least one actuator which is connected to the base body in such a manner that the actuator, during the operation of the furnace muffle, can exert a force on the base body, at least one sensor which is arranged and set up so that it detects a force exerted by the base body during the heating or cooling and/or change in the length of the base body during the heating or cooling, and a control device connected to the actuator and to the sensor, which is set up so that it controls, during the operation of the furnace muffle, the force exerted by the actuator on the base body as a function of the force or the change in length detected by the sensor.

Here, the basic idea of the present invention is to counteract by controlled force application from the outside, i.e., with an appropriate actuator, a thermally caused deformation of the base body of the furnace muffle. If the shape and the expansion of the base body are kept essentially constant, then the wear of the furnace muffle can be considerably reduced.

In order to limit such a deformation of the base body of the furnace muffle, it is necessary to detect the initial deformation of the base body by means of the sensor, and then to counteract this deformation as a function of a value or a measure for the deformation, which is detected by the sensor.

Here, in an embodiment of the invention, the sensor can be arranged and set up so that it detects a tensile force or a compressive force exerted by the base body during a deformation. Alternatively or additionally, the sensor can be set up so that it detects a change in length, i.e., a contraction or expansion of the base body during the heating or cooling of the furnace muffle.

In an embodiment, the control device is then set up so that it actuates the actuator in such a manner that the force exerted by the actuator on the base body compensates at least partially for a change in the length of the base body during the heating or cooling of the furnace muffle, which is detected by the sensor.

In an alternative embodiment, the control device is set up so that it actuates the actuator during the operation of the furnace muffle, so that the force exerted by the actuator on the base body at least partially compensates for a force which is exerted by the base body on the sensor during the heating or cooling of the furnace muffle, and which is detected by said sensor.

In an embodiment of the invention, the actuator is therefore set up and arranged so that it can exert a tensile force and/or compressive force on the base body during the operation of the furnace muffle.

If the base body of a furnace muffle is heated, then the strength of the material of the base body changes and the base body becomes, for example, plastically deformable. This leads to a deformation of the base body as a function of the geometry of the base body. For example, if the base body has a tubular shape with a rectangular cross section or with a cross section that is in the shape of a part of a circle in some sections, then the plastic deformability in turn frequently leads to a collapse of the upper side or of the cover of the base body. The upper side then sags. Such a collapse or sagging of the base body can be counteracted advantageously by exerting tensile forces on the base body. A collapse or sagging of the base body can be detected at its ends as a force exerted by the base body or as a change in the length of the base body.

In order to achieve an appropriate compensation, the control device is set up in an embodiment, so that, during the operation of the furnace muffle, it calculates, from a change in the length of the base body during the heating or cooling, or from a force exerted by the base body during the heating or cooling on the sensor and detected by said sensor, a target value for the force to be exerted by the actuator on the cover, and so that it controls the actuator so that an actual value of the force exerted by the actuator on the base body is substantially equal to the target value.

For controlling the force exerted by the actuator on the base body, an embodiment is advantageous in which the actuator comprises a sensor which, during the operation of the furnace muffle, detects the actual value of the force exerted by the actuator on the cover or a parameter which is a proxy for the actual value of the force exerted by the actuator on the cover.

An actuator in the sense of the present application denotes any device which is suitable for allowing a force that compensates for the thermal deformation of the base body to act on said base body. Examples of such actuators are electromechanical drives, linear drives, spindle drives and piezo actuators. However, such an actuator can also be in particular a pneumatic or hydraulic actuator whose piston which is guided in a cylinder can exert tensile and/or also compressive forces on the base body. However, since it has been found that the largest deformations of the base body occur during the heating of the furnace muffle, it is particularly advantageous to use an embodiment in which the actuator is suitable for exerting an adjustable tensile force on the base body.

In the present application, when reference is made to the term sensor which detects a change in the length of the base body or a force exerted by the base body, then said term can denote in particular a force sensor, for example, a piezo element, or a strain gauge, which is arranged on the base body of the furnace muffle. However, optical sensors capable of detecting a deformation, particularly a change in the length of the base body, are also suitable, for example.

However, in an embodiment of the invention, the actuator itself can also comprise the sensor for a change in the length of the base body. An example of such a design is a hydraulic or pneumatic actuator with a cylinder and with a piston guided in said cylinder, wherein the pressure in the interior of the cylinder can be set via a control valve connected to the control device. Here, the actuator in addition comprises a position encoder for detecting the position of the piston in the cylinder. The piston of the actuator is connected to the base body, for example, to one corner of the base body. In this case, the control device is set up so that it calculates a target pressure in the interior of the cylinder as a function of the actual position of the piston and sets the target pressure in the interior of the cylinder by actuating the control valve. In this example, at a constant pressure in the interior of the cylinder, the position of the piston is a direct measure for a force exerted by the base body on the cylinder or for a change in the length of the base body.

A change in the length of the base body, in particular a shortening of the base body due to sagging of the base body, leads, at a constant pressure in the cylinder, to a change in the position of the piston, which is detected by the position encoder and issued to the control device. In a subsequent step, the control device calculates, from the position change of the piston, a target force that is required to compensate for the deformation of the base body. This target force corresponds to a target pressure of the hydraulic fluid or of the pneumatic gas in the interior of the cylinder, and this target pressure in the interior of the cylinder is set by actuating the control valve of the actuator.

In an embodiment, the actuator advantageously comprises, in addition, a pressure sensor which is connected to the control device, and which is arranged and set up so that it detects the actual pressure in the interior of the cylinder, wherein the control device is set up so that, during the operation of the furnace muffle, it regulates the control valve of the actuator so that the actual pressure in the interior of the cylinder is substantially equal to the target pressure.

All the above described embodiments describe a control or adjustment of the actuator using the control device, so that the force to be exerted by the actuator on the base body is a function of a change in the length of the base body or of a force exerted by the base body. For this purpose, the force exerted by the base body or a change in the length of the base body, or a parameter which depends directly on these parameters, and which thus constitutes a proxy for the force or for a change in length, is detected with the sensor.

However, it has been found that the tensile strength of the base body of the furnace muffle, in particular of a base body made of steel, depends clearly on its temperature. In order to prevent damage to the base body of the muffle, the force exerted by the actuator on the base body, in an embodiment, should depend on the temperature of the base body.

For this purpose, the furnace muffle, in an embodiment, comprises a temperature sensor which is connected to the control device, and which is arranged and set up so that, during the operation of the furnace muffle, it detects the temperature of the base body of the furnace muffle, wherein the control device is set up so that, during the operation of the furnace muffle, it sets the force (target force) to be exerted by the actuator on the base body as a function of the temperature of the base body and as a function of the force or change in length detected with the sensor.

Here, in an embodiment of the invention, the control device is set up so that the force to be exerted by the actuator on the base body is proportional to a force exerted by the base body on the sensor or to a change in the length of the base body. However, the maximum force to be exerted by the actuator on the base body of the furnace muffle is limited here as a function of the temperature of the base body.

A control device in the sense of the present application comprises in particular a hard-wired analog or digital control circuit, but also a multipurpose computer with control software and the required interfaces.

In an advantageous embodiment, the base body is manufactured at least in some sections from metal, preferably steel.

In an embodiment of the invention, the base body of the furnace muffle is substantially cuboidal and the actuator is connected to at least one corner or one edge of the cuboid.

In an embodiment of the invention, the furnace muffle is part of a conveyor furnace, wherein the base body has a first end with an inlet opening for a workpiece to be annealed and a second end facing the inlet opening, wherein the actuator is arranged so that, during the operation of the furnace muffle, it exerts a force exclusively on the first or the second end of the base body.

While it is possible, in principle, to counteract a deformation of the base body of the furnace muffle with at least two actuators which are connected to facing sides, edges or corners of the base body, an advantageous embodiment of the furnace muffle is one in which the base body is clamped in on one side, while the point of attack of at least one actuator is located on a side facing the clamp.

In such an embodiment, it is advantageous to attach a first or a second end of the base body to an immovable muffle holder, wherein the actuator is set up so that, during the operation of the furnace muffle, it exerts a force, preferably a tensile force, on the end of the base body facing the muffle holder. Here, the muffle holder is cooled, in an embodiment of the invention.

In an embodiment of the invention, the furnace muffle comprises multiple actuators and preferably at least three actuators. In a variant of the furnace muffle, in which a first end of the base body is attached to an immovable muffle holder, the multiple actuators are advantageously arranged on a facing end of the base body. Here three actuators are sufficient for stretching the base body of the muffle again substantially back out of any deformation and counteracting a collapse of the base body.

It has been found to be advantageous to provide exactly four actuators in the substantially cuboid base body, which are arranged so that, during the operation of the furnace muffle, they each exert a force on one of the corners of the base body, preferably on four corners of one side surface of the base body. In such an arrangement, the base body can stretched optimally during the operation of the furnace muffle.

In order to be able to stretch the base body in opposition to a thermally caused deformation, it is advantageous if the base body comprises on two facing ends or sides thereof a rigid attachment flange that is not heated. Here, the expression "not heated" means that a flange remains sufficiently cold so that it is not elastically deformable. Such a flange is used for connecting the base body to the muffle holder, on the one hand, and to one or more actuators, on the other hand. Between two such flanges, the base body can be clamped and stretched. Advantageously at least one of the flanges is cooled in order to prevent elastic deformation of the flange.

In an additional embodiment of the invention, the control device is set up so that it calculates a position mean value from a position value of a first position encoder of a first actuator and from a position value of a second position encoder of a second actuator, and it sets the force exerted by the first and by the second actuator on the base body so that the updated position values of the first and of the second position encoder are equal to the calculated position mean value. In this manner, the base body of the furnace muffle can be stretched evenly. In a first embodiment of the invention, the furnace muffle in addition comprises a heating device, which is set up so that, during the operation of the furnace muffle, it can heat the base body in sections. If in an embodiment of the furnace muffle, a first end of the base body is immobilized, for example, by attaching the base body to a muffle holder, while a second end of the base body, which faces the muffle holder, can be exposed by means of at least one actuator to tensile forces, it has been found to be advantageous to bring the base body to operating temperature in sections starting from its immobilized end, so that a section of the base body which is adjacent to the second end reaches the operating temperature last.

The above-mentioned problem is, in addition, also solved by an annealing furnace which comprises a furnace muffle according to an embodiment as described above.

Here, such an annealing furnace is advantageously a conveyor furnace with a conveyor belt which extends at least in some sections into the base body so that a workpiece, for example, a stainless steel tube, can be conveyed on the conveyor belt into and out of the base body.

While it possible to conceive of embodiments of such a conveyor furnace in which the base body of the muffle has a single opening, which is used both for introducing and also for expelling the workpiece into and out of the furnace, respectively, an advantageous embodiment is one in which the conveyor furnace is a continuous furnace. In the case of such a continuous furnace, the conveyor belt extends through the base body so that, during the operation of the annealing furnace, a workpiece can be conveyed in a single transport direction of the belt into and again back out of the annealing furnace. It should be understood that in such an embodiment the base body has two openings through which a workpiece can be conveyed into and out of the base body. Such an embodiment of the annealing furnace has the advantage that the workpiece in the production process has a fixed direction of material flow which facilitates the logistics in the production hall.

Moreover, the above-mentioned problem is also solved by a method for operating a furnace muffle for an annealing furnace, wherein the furnace muffle has a base body which is set up so that the base body delimits a volume to be heated, wherein the method consists of the steps: detecting a force exerted by the base body during the heating or cooling and/or a change in the length of the base body with at least one sensor, exerting a force on the base body with at least one actuator connected to the base body, and controlling the force exerted by the actuator on the base body as a function of the force or the change in length detected by the sensor with a control device.

To the extent that the above aspects of the invention have been described in regard to the furnace muffle according to the invention or the annealing furnace according to the invention, they also apply to the method according to the invention for operating a furnace muffle. To the extent that the method is carried out with a furnace muffle according to this invention, said muffle also comprises the appropriate devices for that purpose. But the embodiments of the furnace muffle according to the invention are suitable, in particular, for carrying out the above-described method.

Additional advantages, features and application possibilities of the present invention become apparent on the basis of the following description of an embodiment and the associated figures.

BRIEF DESCRIPTION OF THE DRAWINGS

In the figures, identical elements are marked with identical reference numerals.

DETAILED DESCRIPTION

Figure 1:
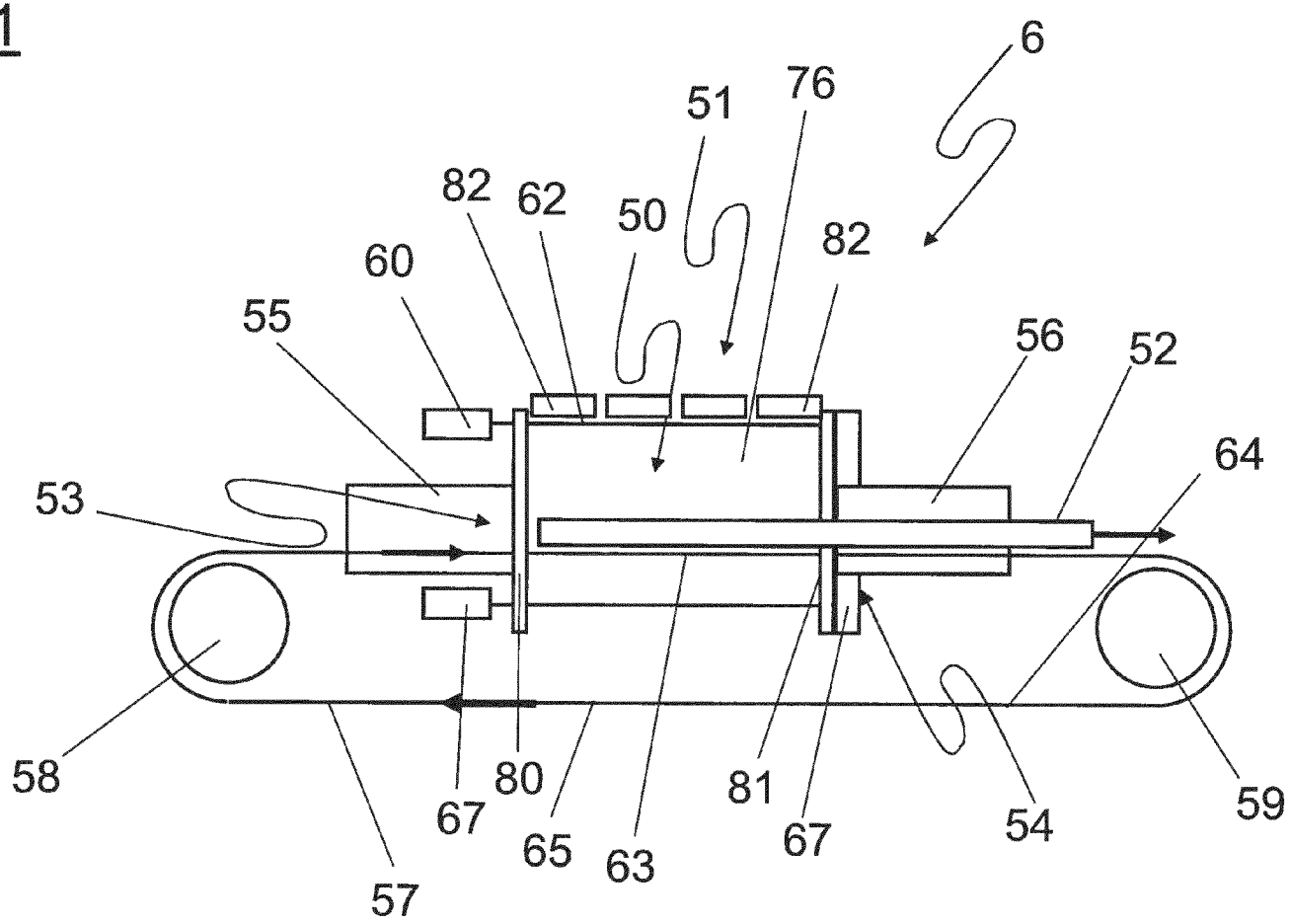
FIG. 1 shows a diagrammatic cross-sectional view of an embodiment of an annealing furnace with a furnace muffle according to the invention.

FIG. 1 shows a diagrammatic side view of an annealing furnace designed as a conveyor furnace 6, which has a design of the furnace muffle 51 according to the present invention.

The core of the conveyor furnace 6 is a temperature-controlled volume 50, that is to say a volume to be heated, of the furnace, which is surrounded by a base body 62. In the volume 50 enclosed by the base body 62, a workpiece, in the present case a stainless steel tube 52, is annealed. This annealing occurs at a temperature of 1080° C. The base body (62) of the furnace muffle 51 encloses the volume 50 to be temperature-controlled, in particular with a cover 62 and side walls.

The annealing process here occurs continuously, i.e., the tube 52 is introduced (in the represented embodiment from the left side) into the furnace 6, so that it is heated slowly to the nominal temperature of 1080° C., wherein the tube is moved continuously in the longitudinal direction through the base body 62 of the furnace muffle 51 and then it exits the furnace 6 again (in the represented embodiment on the right side of the furnace muffle 51). This means that, while a portion of the tube 52 within the furnace muffle 51 reaches the nominal temperature, other portions of the tube outside of the furnace muffle 51 can either be still before the furnace muffle 51 or already after the furnace muffle 51.

The base body 62 has an inlet opening 53 and an outlet opening 54, which are open in order to allow a continuous operation of the furnace. In order to prevent unnecessary heat losses in the volume 50 which is to be heated and which is enclosed by the base body 62 of the furnace muffle 51, lock chambers 55, 56 are provided before the inlet opening 53 and the outlet opening 54, respectively, which are flushed with gaseous hydrogen in order to keep convection losses of the temperature-controlled volume 50 as low as possible. In addition, the hydrogen flushing in the lock chambers 55, 56 ensures that as little ambient air as possible enters the base body 62 of the furnace muffle 51, and the annealing process can take place there under a protective gas atmosphere. In the present case, the annealing in the base body 62 take place in a hydrogen environment.

In order to allow a continuous entrance and discharge of stainless steel tubes 52 into and out of the furnace 6, the furnace 6 is designed as a conveyor furnace, i.e., it has a conveyor belt 57 which, as a closed belt, allows a continuous linear movement of the tubes 52 through the furnace. In addition, the conveyor belt 57 is clamped between two rollers 58, 59, which are mounted rotatably about rotation axes. Since the roller 58 is motor driven, the rotating movement of the roller 58 is converted into a circulating movement of the conveyor belt 57. For this purpose, a first section 63 of the conveyor belt 57 extends through the furnace muffle 51. An additional section 65 of the conveyor belt 57 moves in a second direction opposite from the direction of movement of the first section 63. The conveyor belt 57 is a mesh belt made of stainless steel.

In FIG. 1 one can also see, in a diagrammatic representation, that the furnace muffle 51 comprises a total of four actuators 60, 61, 66, 67 (of which two actuators 60, 67 are represented in FIG. 1). They engage with the base body 62 of the furnace muffle 51 and they help counteract a deformation of the base body 62 of the furnace muffle 51.

During the heating, the base body 62 is stretched by the actuators 60, 61, 66, 67. For this purpose, the base body 62 is screwed at its second, outlet-side end by means of a flange plate 81 to a muffle holder 76. This end of the base body is therefor immobilized and it cannot be moved during the operation of the furnace. In order to counteract a deformation of the immobilized flange plate 81, the latter is cooled in the represented embodiment.

The first, inlet-side end of the base body 62 also comprises a flange plate 81. However, said flange plate is connected at its four corners 68, 69, 70, 71 in each case to an actuator 60, 61, 66, 67.

The actuators 60, 61, 66, 67 are pneumatic actuators which are set up and arranged so that they can exert tensile forces on the flange plate 80 and thus on the base body 62 of the furnace muffle 51. In this manner, the actuators stretch the base body 62 of the furnace muffle 51.

In the side view of FIG. 1, one can see that, during the heating of the base body 62 of the furnace muffle 51, the walls of the base body 62, which assume a plastic deformable state during the heating, collapse. The tensile forces exerted by the actuators 60, 61, 66, 67 then counteract such a thermal deformation of the base body.

Figure 2:
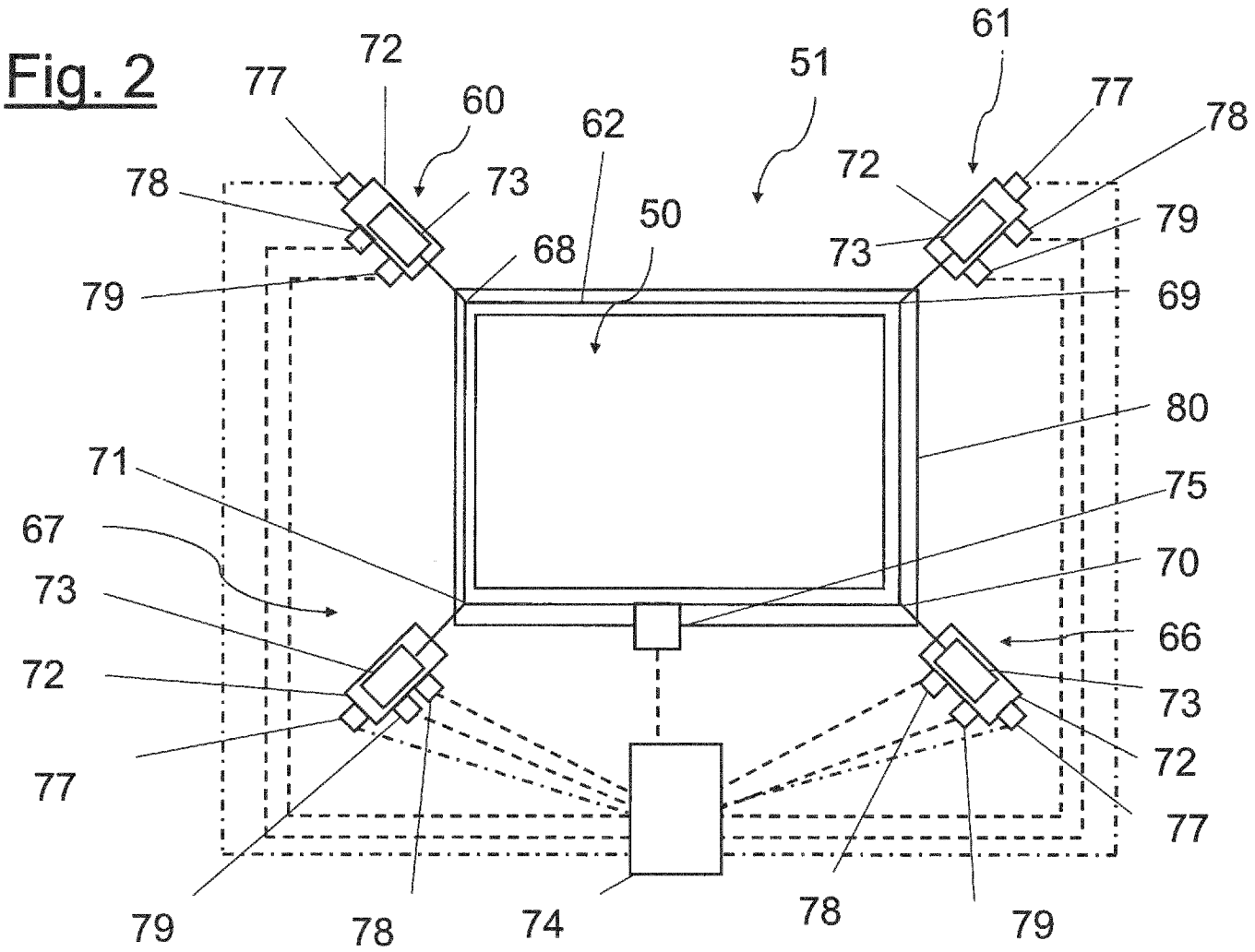
FIG. 2 shows a diagrammatic side view of the inlet-side end of the base body of the furnace muffle of FIG. 1.

FIG. 2 diagrammatically shows a side view of the furnace muffle 51, wherein, in this diagrammatic view, a top view of the inlet-side end of the base body 62 or of its flange plate 80 as well as of the four actuators 60, 61, 66, 67 is shown. Here, merely to improve the ease of representation, the actuators 60, 61, 66, 67 are shown as if they engaged at an angle with the flange plate 80. However, the actuators in fact exert tensile forces on the flange plate 80 that are substantially parallel to the run-through direction, i.e., to the longitudinal extent of the base body 62.

From the representation of FIG. 2 it becomes apparent that the four actuators 60, 61, 66 and 67 engage at the four corners 68, 69, 70, 71 of the flange plate 80.

Each one of the four pneumatic actuators 60, 61, 66, 67 has a (pressure) cylinder 72 and a piston 73 arranged in said cylinder. Here, the piston 73 is connected to a corner point 68, 69, 70, 71 of the flange plate 80. By means of a control valve 77, which is connected to a pressure line of a pneumatic system (not shown in FIG. 2) and via a control line to a control device 74 (here a computer with interfaces and control and regulation software), the pressure in the interior of the cylinder 72 and thus the tensile force exerted by the piston 73 on the flange plate 80 can be set or adjusted.

In order to be able to adjust the actual pressure in the interior of the cylinder to the target value, which is predetermined by the control device for the pressure in the interior of the cylinder 72, each actuator also has a pressure sensor 79 which detects the actual value of the pressure in the interior of the cylinder and conveys it via a measurement line to the control device 74.

In addition, each actuator 60, 61, 66, 67 has a position encoder 78 which is also connected via a measurement line to the control device 74. The position encoder 78 detects the current actual position of the piston and conveys this position to the control device 74.

A temperature sensor 75 is arranged on the base body 62 of the furnace muffle and detects the temperature T of the base body 62. The temperature sensor is also connected via a measurement line to the control device 74 and it conveys the actual value of the temperature of the base body 62 to said control device.

The furnace muffle 51, furthermore, comprises a heating device 82 (see FIG. 1), which makes it possible to heat the base body 62 in sections along its longitudinal direction. In the represented embodiment, the heating device 82 has four heaters for this purpose, each of which heats a section of the base body. The heaters here are controlled so that, at the time of the startup of the furnace, they heat the base body successively starting from its outlet-end. In other words, at the time of the startup of the furnace, the inlet-side end of the base body reaches the operating temperature of the annealing furnace last.

In order to better understand the control mechanism which is used for stretching the furnace muffle or its base body, said mechanism is now described using a concrete example.

If the base body 62 of the furnace muffle 51 is heated, then this base body, which is made of steel, assumes a consistency that makes it plastically deformable. Owing to the force of gravity, the walls and the cover of the base body start to collapse. Stretching the base body by means of the actuators 60, 61, 66, 67 counteracts this collapse.

In order to be able to carry out this stretching in the most controlled manner possible, at the time of the startup of the furnace, the base body 62 of the furnace muffle 51 is first heated at its outlet-side end and the heating then continues successively, i.e., in small segments, until the inlet end is reached. In this manner, in each case only a section of the base body 62 defined by the respective heater is stretched by the actuators 60, 61, 66, 67.

An incipient collapse of the walls of the base body 62 first leads to some shortening of the base body. At a constant pneumatic pressure in the interior of the cylinder 72 of the actuators, a shortening of the base body 62 leads to the pistons 73 of the actuators 60, 61, 66, 67 leaving their initial starting position and moving in the direction toward the muffle holder 76. This position change is detected by the position encoders 78 of the actuators 60, 61, 66, 67.

From this position change, which is a direct measure both for a change in the tensile force exerted by the base body 62 and also for the change in the length of the base body 62, the control device 74 calculates a new target value for the tensile force of each actuator 60, 61, 66, 67 and thus for the target pressure within each cylinder 72 of the actuators 60, 61, 66, 67.

However, the maximum of the new target value for the pressure in the interior of the cylinder 72 is limited by the control device as a function of the temperature of the base body 62 of the furnace muffle 51, which is detected by the temperature sensor 75. Since the tensile strength of the base body 62 of the furnace muffle 51 decreases with increasing temperature, tearing of the base body 62 is prevented in this manner.

As a function of the calculated target value for pressure in the interior of the cylinder 72, the control valve 77 of each actuator 60, 61, 66, 67 is opened or closed by the control device, until the actual pressure measured by the pressure sensor 79 reaches the calculated target pressure in the piston 72.

The purpose of stretching the base body 62 by means of the actuators 60, 61, 66, 67 is to counteract a collapse of the walls of the base body 62, in order primarily to extend its lifespan.

It has been shown that the change in the length of the base body 62, during the heating of the muffle, does not lead to equal position changes of the pistons 73 in the cylinders 72 of the individual actuators 60, 61, 66, 67. Rather, each piston 73 undergoes a different individual position change, which is detected by the respective position encoder 78 of the actuator 60, 61, 66, 67. In the represented embodiment of the invention, the control device 74 calculates, from the four position values of the piston 73, which are determined by the position encoders 78, a mean value of the position of all the four pistons 73, which is then set to a calculated target pressure by setting the corresponding actual pressure in the individual cylinders 72 of the actuators 60, 61, 66, 67.

If the desired target pressure in the interior of a cylinder 72, which corresponds directly to a force exerted by the actuator in question on the flange plate 80 and thus on the base body 62 of the furnace muffle 51, exceeds a certain threshold value, which depends on the temperature of the base body 62, then the target pressure of this actuator, which is to be set, is adjusted so that it remains below the threshold value, in order to prevent damaging the base body 62 of the furnace muffle 51 due to the tensile force of the actuator.

Figure 3:
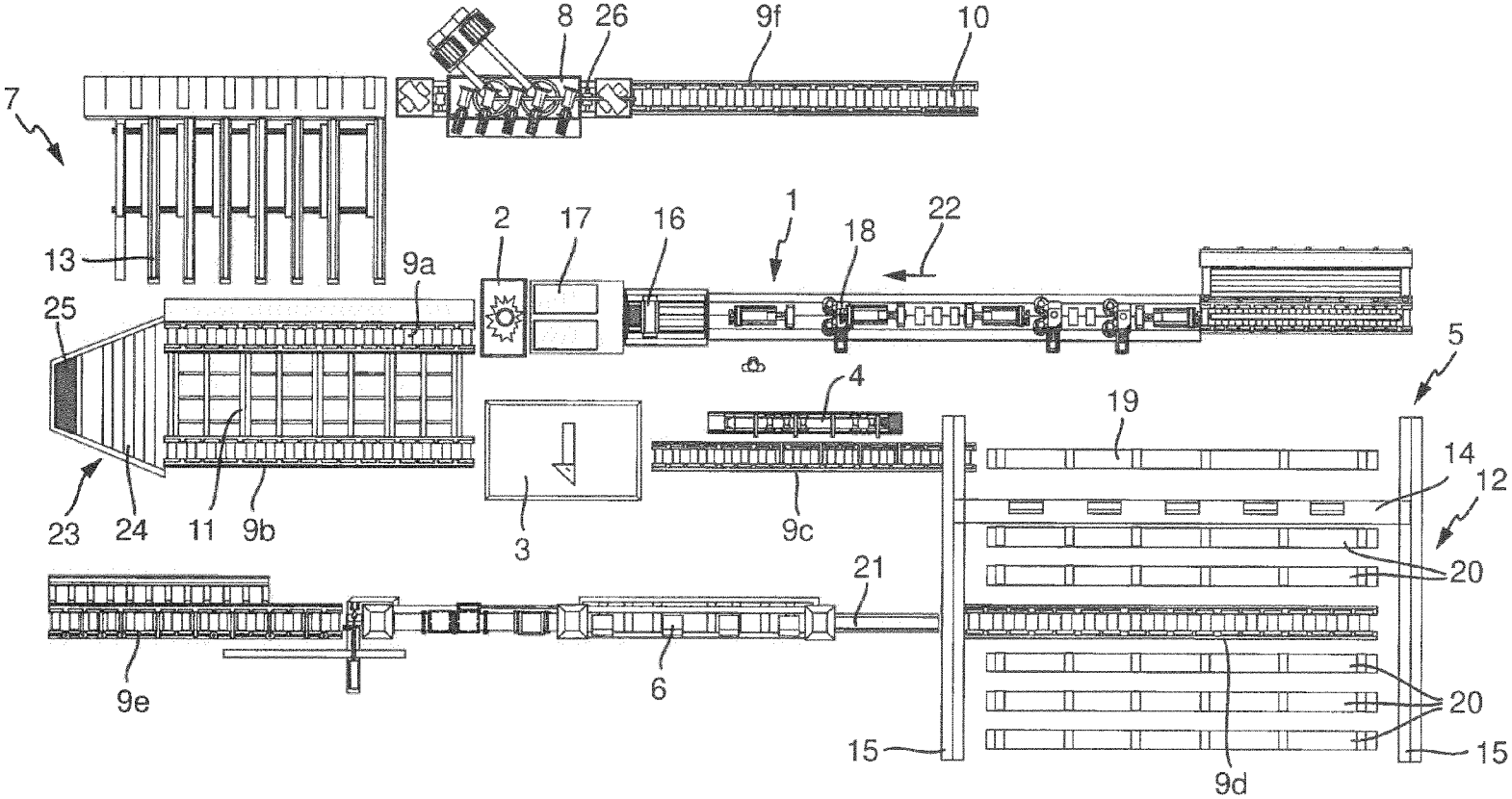
FIG. 3 diagrammatically shows the arrangement of an annealing furnace of FIG. 1 in a cold pilger rolling mill train.

The rolling mill train depicted in FIG. 3 comprises, in addition to the annealing furnace 6 designed according to the invention, the following processing stations for producing a high-quality stainless steel tube: a cold pilger rolling mill 1, a device for degreasing 2 the outer wall of the tube, a parting off device 3 for cutting the tube to length, a device for degreasing 4 the tube inner wall as well as for processing the ends of the tube, a first buffer 5 for the tubes, a second buffer 7 for the tubes as well as a straightening machine 8.

In the rolling mill train, the flow direction or conveyance direction of the hollow shell or, after the cold pilger rolling mill, of the tube, is from the cold pilger rolling mill 1 to the outlet of the straightening machine 8.

The cold pilger rolling mill 1 consists of a rolling stand 16 with rolls, a calibrated rolling mandrel as well as a drive 17 for the rolling stand 16. The drive for the rolling stand 16 has a push rod, a drive motor, and a flywheel. A first end of the push rod is secured eccentrically relative to the rotation axis of the drive shaft on the flywheel. As a result of the action of a torque, the flywheel rotates about its rotation axis. The push rod arranged with its first end with radial separation from the rotation axis is exposed to a tangential force and transmits the latter to the second push rod end. The rolling stand 16, which is connected to the second push rod end, is moved back and forth along the direction of movement 22 established by a guide rail of the rolling stand 16.

During the cold pilgering in the cold pilger rolling mill 1 shown diagrammatically in FIG. 3, the hollow shell introduced into the cold pilger rolling mill 1 in the direction 22, i.e., a tube blank, is fed stepwise in the direction toward the rolling mandrel or over and past said rolling mandrel, while the rolls of the rolling stand 16, as they rotate over the mandrel and thus over the hollow shell, are moved horizontally back and forth. Here, the horizontal movement of the rolls is predetermined by the rolling stand 16 itself, on which the rolls are rotatably mounted. The rolling stand 16 is moved back and forth in a direction parallel to the rolling mandrel, while the rolls themselves are set in their rotating movement by a rack which is stationary relative to the rolling stand 16, and with which toothed wheels that are firmly connected to the roll axles engage.

The feeding of the hollow shell over the mandrel occurs by means of the feeding clamping carriage 18, which allows a translation movement in a direction 16 parallel to the axis of the rolling mandrel. The conically calibrated rolls arranged one above the other in the rolling stand 16 rotate against the feeding direction 16 of the feeding clamping carriage 18. The so-called pilgering mouth formed by the rolls grips the hollow shell, and the rolls push off a small wave of material from outside, which is stretched out by a smoothing pass of the rolls and by the rolling mandrel to the intended wall thickness, until an idle pass of the rolls releases the finished tube. During the rolling, the rolling stand 16 with the rolls attached to it moves against the feeding direction 22 of the hollow shell. By means of the feeding clamping carriage 18, the hollow shell is advanced by an additional step onto the rolling mandrel, after the idle pass of the rolls has been reached, while the rolls with the rolling stand 16 return to their horizontal starting position. At the same time, the hollow shell undergoes a rotation about its axis, in order to reach a uniform shape of the finished tube. As a result of repeated rolling of each tube section, a uniform wall thickness and roundness of the tube as well as uniform inner and outer diameters are achieved.

A central sequential control device of the rolling mill train controls all the at first independent processing stations, thus including the drives of the cold pilger rolling mill 1 itself.

After the exit from the cold pilger rolling mill 1, the finished reduced tube is degreased on its outer wall at a degreaser 2.

During the subsequent parting off in the parting off device 3, a lathe tool is rotated about the longitudinal axis of the tube and at the same time it is positioned radially on or in the tube so that the tube is divided and two tube sections are formed.

The parted off tube, i.e., the tube that has been cut to a set length, leaves the parting off device 3, is placed in a degreaser 4 for degreasing the inner wall of the tube. In the represented embodiment, a surface milling of the end sides of the tube (processing of the ends) also occurs in the degreaser 4, so that said end sides exhibit the planarity required for subsequent orbital welding of several tube sections to one another.

In the conveyor furnace 6 designed according to the invention, as shown in detail in FIGS. 1 and 2, an individual tube or a bundle of tubes is annealed for stabilization, i.e., brought to a temperature of 1080° C.

It has been found to be potentially disadvantageous that the tubes buckle due to the high temperatures in the annealing furnace 6, and, after leaving the furnace, they are no longer straight, instead they have in particular waves over their longitudinal extent. Therefore, a final processing step is therefore in a so-called cross rolling-straightening machine 8, in which the tubes that leave the furnace 6 are straightened.

In the embodiment represented, after the straightening machine 8, a device for flat grinding is also provided, in which two rotating fleece disks 26 come into a frictional engagement with the finished tube, which has a polishing effect.

For the purpose of the original disclosure, reference is made to the fact that all the features, as they are disclosed to a person skilled in the art from the present description, the drawings and the claims, even if they have been described in concrete terms only in connection with certain additional features, can be combined both individually and also in any desired combinations with other features or groups of features disclosed here, to the extent that this is not explicitly excluded, or to the extent that technical circumstances make such combinations impossible or unreasonable. A comprehensive, explicit description of all the conceivable combinations of features is omitted here only for the sake of the brevity and readability of the description. While the invention has been represented and described in detail in the drawings and in the above description, this representation and this description occur only by way of example and are not intended to limit the scope of protection as defined by the claims. The invention is not limited to the embodiments that have been disclosed.

Variant forms of the disclosed embodiments are evident to the person skilled in the art from the drawings, the description and the appended claims. In the claims, the word "comprise" does not exclude other elements or steps, and the indefinite article "an" or "a" does not exclude a plural. The mere fact that certain features are claimed in different claims does not rule out their combination. Reference numerals in the claims are not intended to limit the scope of protection.

The invention claimed is:

1. A furnace muffle for an annealing furnace comprising:

a base body arranged to delimit a volume to be heated;

at least one actuator connected to the base body such that the actuator, during the operation of the furnace muffle, is arranged to exert a tensile force on the base body;

at least one sensor arranged to detect a force exerted by the base body during heating or cooling and/or a change in the length of the base body during the heating or cooling; and a control device connected to the actuator and to the sensor, arranged to, during the operation of the furnace muffle, control the tensile force exerted by the actuator on the base body as a function of the force or the change in length detected by the sensor.

2. The furnace muffle according to claim 1, wherein the control device is arranged such that, during the operation of the furnace muffle, it controls the actuator so that the tensile force exerted by the actuator on the base body compensates at least partially for a change in the length of the base body, which is detected by the at least one sensor, during the heating or cooling, or for the force exerted by the base body during the heating or cooling on the at least one sensor, and detected by the at least one sensor.

3. The furnace muffle according to claim 1, wherein the control device is arranged to calculate, from a change in the length of the base body, which is detected by the at least one sensor, during the heating or cooling, or from the force exerted by the base body during the heating or cooling and detected by the at least one sensor, a target value for the tensile force to be exerted by the actuator on the base body, and in that it regulates the actuator so that an actual value of the tensile force exerted by the actuator on the base body is substantially equal to the target value.

4. The furnace muffle according to claim 3, wherein the actuator includes a pressure sensor, which detects the actual value of the tensile force exerted by the actuator on the base body, or a parameter which is a measure for the actual value of the tensile force exerted by the actuator on the base body.

5. The furnace muffle according to claim 1, wherein the actuator is a pneumatic or hydraulic actuator with a piston guided in a cylinder, wherein the piston is connected to the base body, wherein the pressure in the interior of the cylinder can be set via a control valve connected to the control device, wherein the at least one sensor, arranged to detect a change in the length of the base body, is a position encoder arranged to detect an actual position of the piston, and in that the control device is arranged to calculate a target pressure in the interior of the cylinder as a function of the actual position of the piston and sets the target pressure in the interior of the cylinder by actuating the control valve.

6. The furnace muffle according to claim 5, wherein the actuator includes a pressure sensor connected to the control device, wherein the pressure sensor is arranged to detect an actual pressure in the interior of the cylinder, and in that the control device is arranged such that during the operation of the furnace muffle it adjusts the control valve of the actuator so that the actual pressure in the interior of the cylinder is substantially equal to the target pressure.

7. The furnace muffle according to claim 1, further comprising a temperature sensor connected to the control device and arranged during the operation of the furnace muffle, to detect the temperature of the base body, wherein the control device is arranged so that it calculates, during the operation of the furnace muffle, the force to be exerted by the actuator on the base body as a function of the temperature of the base body and of the force or change in length of the base body detected by the at least one sensor.

8. A furnace muffle for an annealing furnace comprising:

a base body arranged to delimit a volume to be heated, wherein the base body includes a first end with an inlet opening for a workpiece to be annealed and a second end facing the inlet opening;

at least one actuator connected to the base body, the actuator being arranged, during the operation of the furnace muffle, to exert a tensile force on the base body exclusively from the first end or from the second end of the base body;

at least one sensor arranged to detect a force exerted by the base body during heating or cooling and/or a change in the length of the base body during the heating or cooling; and a control device connected to the actuator and to the at least one sensor, arranged to, during the operation of the furnace muffle, control the tensile force exerted by the actuator on the base body as a function of the force or the change in length detected by the at least one sensor.

9. The furnace muffle according to claim 8, wherein the first end or the second end of the base body is attached to a muffle holder, the actuator being arranged such that, during the operation of the furnace muffle, it exerts the force on the end of the base body attached to the muffle holder.

10. The furnace muffle according to claim 9, wherein the furnace muffle includes a plurality of actuators, the base body having a substantially rectangular cross section, the plurality of actuators being arranged so that during the operation of the furnace muffle, one actuator exerts the tensile force on each corner of the base body.

11. The furnace muffle according to claim 10, wherein the at least one sensor is a position encoder, the control device being arranged to calculate, from a position value of a first position encoder of a first actuator and from a position value of a second position encoder of a second actuator, a position mean value, setting the force exerted by the first actuator and by the second actuator on the base body so that updated position values of the first position encoder and of the second position encoder are equal to the calculated position mean value.

12. The furnace muffle according to claim 8, further comprising a heating device arranged, during the operation of the furnace muffle, to heat the base body in sections, wherein the heating device is arranged so that the base body during the operation of the furnace muffle, is brought to an operating temperature in sections starting from its immobilized end, so that a section of the base body which is adjacent to the second end reaches the operating temperature last.

13. An annealing furnace comprising a furnace muffle including a base body arranged to delimit a volume to be heated, at least one actuator connected to the base body such that the actuator, during the operation of the furnace muffle, is arranged to exert a tensile force on the base body, at least one sensor arranged to detect a force exerted by the base body during heating or cooling and/or a change in the length of the base body during the heating or cooling, and a control device connected to the actuator and to the at least one sensor, the control device being arranged to, during the operation of the furnace muffle, control the tensile force exerted by the actuator on the base body as a function of the force or the change in length detected by the at least one sensor, wherein the annealing furnace is a conveyor furnace with a conveyor belt, wherein the conveyor belt extends in sections into the base body of the furnace muffle so that a workpiece on the conveyor belt can be conveyed into and out of the base body.

14. A method for operating a furnace muffle for an annealing furnace, the furnace muffle including a base body arranged so that the base body delimits a volume to be heated, comprising the steps:

detecting a force exerted by the base body during the heating or cooling and/or a change in a length of the base body with at least one sensor;

exerting a tensile force on the base body with at least one actuator connected to the base body; and controlling the tensile force exerted by the actuator on the base body as a function of the force or change in length detected by the sensor with a control device.

* * * * *